US005081100A

United States Patent [19]

Matsushita et al.

[11] Patent Number: 5,081,100

[45] Date of Patent: Jan. 14, 1992

[54] HEAT TRANSFER RECORDING MATERIAL

[75] Inventors: Toshihiko Matsushita, Tokyo; Megumi Ikeda, Abiko; Hideo Makishima, Tokyo, all of Japan

[73] Assignee: Mitsubishi Paper Mills Limited, Tokyo, Japan

[21] Appl. No.: 585,863

[22] Filed: Sep. 18, 1990

[30] Foreign Application Priority Data

Sep. 18, 1989 [JP] Japan ..... 1-242864
Oct. 13, 1989 [JP] Japan ..... 1-267096

[51] Int. Cl.[5] ..... B41M 5/35; B41M 5/26

[52] U.S. Cl. ..... 503/227; 8/471; 428/195; 428/523; 428/910; 428/913; 428/914

[58] Field of Search ..... 8/471; 428/195, 523, 428/910, 913, 914; 503/227

[56] References Cited

U.S. PATENT DOCUMENTS 4,572,860 2/1986 Nakamura et al. ..... 428/216
4,707,404 11/1987 Morishita et al. ..... 428/335

FOREIGN PATENT DOCUMENTS 55-007467 1/1980 Japan ..... 503/227
56-155794 12/1981 Japan ..... 503/227
57-74195 5/1982 Japan ..... 503/227
59-148697 8/1984 Japan ..... 503/227
60-210494 10/1985 Japan ..... 503/227

*Primary Examiner*—Bruce H. Hess
*Attorney, Agent, or Firm*—Wegner, Cantor Mueller & Player

[57] ABSTRACT

A heat-transfer recording material comprising a thin film support having a thermally meltable or thermally sublimable ink layer applied on one side thereof, said thin film support being made of a stretched, cross-linked polyethylene film. The ink layer contains preferably 2 to 15% by weight an oily antistatic agent. The heat transfer recording material is excellent in antisticking property and suitability for film.

11 Claims, No Drawings

HEAT TRANSFER RECORDING MATERIAL

The present invention relates to a heat transfer recording material, and more particularly, to a heat transfer recording material having an antisticking property and an excellent suitability for film using as a thin film support a stretched crosslinked polyethylene film.

Recently, in thermal printers, thermal facsimile and the like, heat transfer recording materials comprising a thin film support coated with a thermally meltable or thermally sublimable ink (referred to as heat transfer ink by the abbreviations, hereinunder) have been used to provide sharp and fast images on receiving sheets. The principle of the heat transfer recording may be explained as follows: That is, a heat transfer recording material having a heat transfer ink layer is overlaid on a receiving sheet with the surface of the ink layer facing to the sheet, and heated on the opposite side of the recording material to the ink layer with a thermal head operated by an electrical signal to heat selectively a part of the ink which is to be transferred to the receiving sheet. The recording is completed by separating the recording material from the receiving sheet.

Thin film supports to be used in the heat transfer recording material are required to have such a heat resistant property as to be capable of withstanding the temperature to which the thermal head may be heated (250° to 350° C.). Preferred materials for the support have been condenser insulating sheets and cellophane sheets which are unmeltable, and heat resistant films such as polyimide and Teflon films which are capable of withstanding the high temperature of the heated thermal head. Other films such as polystyrene, polyethylene, polyvinyl chloride, polyvinylidene chloride, polyethylene terephthalate, and polycarbonate films have a lower melting point than the temperature of the heated thermal head o that during printing, they may fuse and stick to the thermal head causing a phenomenon so-called "sticking" which prevents the thermal head from running.

In the case the supports which may cause where sticking phenomenon are used, for preventing it, Japanese Patent KOKAI (Laid-open) No. sho 55-7467 proposes that a heat resistant protective film made of a resin selected from the group consisting of Silicone, epoxy, melamine, phenolic, fluorocarbon and polyimide resins, or nitrocellulose is provided on the surface of the support on the side to be in contact with the thermal head.

Japanese Patent KOKAI (Laid-open) No. sho 56-155794 discloses those comprising a plastic film having a stick-preventing layer applied on one side thereof which consists of a highly slippery inorganic pigment and a heat setting or high softening point resin material.

Japanese Patent KOKOKU (Post Exam.) No. sho 57-74195 discloses those comprising a plastic film having a stick-preventing layer applied on one side thereof which is selected from three dimensionally cross-linked layers of silicon oxides or multi-functional (meth)acrylates.

The present applicant also proposes a method of preventing the sticking by coating or impregnating a thin film support with wax, and/or substances which are in a liquid or paste state at room temperature, as disclosed in Japanese Patent KOKAI(Laid-open) No. sho 59-148697. The procedures such as coating and impregnating, however, add one stage to the production line resulting in an increase in cost.

As disclosed in Japanese Patent KOKAI (Laid-open) Nos. sho 60-210494 and sho 60-245595, the present applicant also proposes the use of a polyethylene film having a density of 0.935 or more (the former application), or having a density not less than 0.935 and a weight average molecular weight not less than 200,000 (the latter application) as a thin film support. However, the polyethylene films used in the applications are produced by an inflation method or T-die method, and suffer from inferior suitability for film in that as the films are thinner, they become more prone to wrinkling during winding up, and that when the films are coated with a heat transfer ink, they are apt to be elongated, and again during winding up they are prone to wrinkling.

It is an object of the present invention to provide a heat transfer recording material having an antisticking property and a high suitability for film.

According to the present invention, there is provided a heat transfer recording material comprising a thin film support having a thermally meltable or sublimable ink layer applied on on side thereof where said thin film support is made of a stretched cross-linked polyethylene film.

Preferably, the stretched cross-linked polyethylene films to be used in the present invention are produced by melt-extruding a polyethylene resin into a film by the T-die method, irradiating the film with an electron beam, and then heating and stretching the irradiated film.

It is also preferable that the stretched cross-linked polyethylene films consist essentially of a polyethylene resin having a density not less than 0.935, and more preferably not less than 0.950.

The ink layer preferably contains an oily antistatic agent in an amount of 2 to 15% by weight based on the weight of the ink layer.

The present invention will be in detail explained hereinbelow.

The stretched cross-linked polyethylene films used in the present invention are those having a reducing cross-linking degree in a depth direction from the surfaces and having been uniaxially or biaxially stretched. A process for producing the films comprises preferably supplying a polyethylene resin to a conventional extruder, melt-extruding the resin into a film, irradiating the film with an electron beam to cross-link it, and then stretching the irradiated film under heating. In the melt-extrusion, a flat sheet can be produced as by extruding the resin through a conventional T-die. The cross-linking of the resulting sheet may be achieved by subjecting the sheet to a cross-linking condition from the both sides thereof in such a manner as a cross-linking degree is progressively reduced in a depth direction from the surfaces through thickness. The cross-linking degree may be expressed in terms of gel fraction. The cross-linked sheet has preferably a lower cross-linking degree (0 to less than 5%) in the inner portion, and a higher degree (5% or more) in the outer portion. A method of cross-linking may comprise irradiating the sheet at both sides thereof with an electron beam in a dosage of 5 to 50 Mrad., and preferably 5 to 30 Mrad. The stretching may be performed by any one of conventional rolling, tentering, tubulating, and roll-milling methods to stretch uniaxially or biaxially the irradiated sheet so as to produce a stretched film.

The cross-linked polyethylene films as described above are easily stretchable due to the cross-linking effected with electron beam so that they can be retained in the non-wrinkled uniform state.

In printing with heat transfer recording materials, the temperature of a thermal head in use may reach 250° to 350° C. so that conventional thermoplastic resin films are generally subjected to melting and quenching while running. More recently, thermal printers and thermal facsimiles work at such a high speed that the films are not cooled up to room temperature upon quenching and run still in the heated state, though the temperature may vary depending upon the type of the apparatus.

The sticking phenomenon is influenced by the temperatures of the support and the thermal head in the heated or the cooled state, a period of time during which they are in the heated or cooled state, and even by the melting point and the density of the support. It is also delicately influenced by whether a line head or a serial head is used.

The stretched cross-linked polyethylene films of the present invention are not subjected to thermal deformation at the time of contacting with the thermal head due to their high density, though they may locally melt instantaneously. The thermal head is operated to run while melting locally the polyethylene film. It may be speculated that the polyethylene is less adhesive to the thermal head, and rather has a releasing property acting as a lubricant causing no sticking phenomenon.

As a result of the above fundamental consideration, the present inventors have found that among various materials, polyethylene films have a good antisticking property, (see, Japanese Patent KOKAI (Laid-open) No. sho 60-21094), and achieved the stretched cross-linked polyethylene films which do not wrinkle during winding up, that is, have a high suitability for film.

In order to obtain a heat transfer recording material having such a high antisticking property as required in a certain thermal printer, the ink layer preferably contains an oily antistatic agent in an amount of 2 to 15% by weight based on the weight of the ink layer. The inclusion of the oily antistatic agent improves the antisticking property, which may be considered to be caused for the following reasons:

A support is coated with a thermally meltable ink containing 2 to 15% by weight of an oily antistatic agent by a conventional applying method. The resulting heat transfer recording material is usually preserved in a rolled state. The oily antistatic agent migrates to the surface of the ink layer with time, and is deposited to the side bearing no ink layer of an adjacent portion of the support. Therefore, the same situation as that where the side bearing no ink layer has been precoated with the oily antistatic agent is realized. The heat transfer recording material having the oily antistatic agent exhibits an enhanced running property owing to the lubricant effect of the oily antistatic agent when an energy is supplied by contacting with the thermal head.

Moreover, the inclusion of the oily antistatic agent in the ink layer improves also the antistatic property of the heat transfer recording material.

Oily antistatic agents to be used in the present invention include nonionic surfactants, anionic surfactants, cationic surfactants, and ampholytic surfactants. For example, polyoxyethylene oleyl ether, sorbitan palmitate ester, sorbitan fatty acid esters, glycerin fatty acid esters, polyoxy fatty acid amides, sorbitan laurate, alkyl phosphates, aromatic phosphate esters, alkyltrimethylammonium chlorides, oxyethylene dodecyl amines, lauryl betaines, stearyl betaines, dimethylalkyl betaines and the like may be mentioned.

The stretched cross-linked polyethylene films for use as the thin film support of the present invention should have a thickness of not higher than 30 μm, preferably 20 μm or less, more preferably 15 μm or less.

The heat transfer recording materials of the present invention comprise a polyethylene film having a thermally transferable ink layer applied on one side thereof, said heat transferable ink layer comprising a thermally meltable or thermally sublimable ink.

Thermally meltable inks are mainly composed of a colorant, wax and a resin.

Colorants to be used include, for example, Benzidine Yellow G for yellow, Rhodamine Y lake for magenta, Phthalocyanine Blue for cyan, and carbon black for black, and the like. Waxes to be used include, for example, paraffin wax, carnauba wax, microcrystalline wax, lower molecular weight polyethylene wax, polyethylene oxide wax, and synthesized wax. Resins to be used include, for example, ethylene/vinyl acetate copolymers, ethylene/ethyl acrylate copolymers, fatty acid based hydrocarbon resins, and aromatic hydrocarbon resins. Other additives such as pigment dispersants, oil, and the like may be added to the ink, if necessary.

Thermally sublimable inks are mainly composed of a dyestuff, a binder, and a solvent for dissolving or dispersing the binder. The dyestuff should have a sublimation temperature in the range of, preferably 70° to 400° C., most preferably 150° to 250° C. For example, disperse dyes such as Disperse Blue 20 (available under the tradename, Duranol Blue 2G), Disperse Yellow 42 (available under the tradename, Resulinn Yellow GR), and Disperse Red 1 (available under the tradename, Celition Scarlet B); quinalizarin dyes, dispersive monoazo dyes, dispersive anthraquinone dyes, dispersive nitrodiphenylamine dyes, anthracene dyes, and the like may be used. Binders to be used include cellulose based resins such as methylcellulose, ethylcellulose, hydroxyethylcellulose; acrylic resins; vinyl resins such as polyvinyl alcohol resins, polyvinyl acetate resins; rosin based resins; polyamide resins; phenolic resins; alkid resins; polyurethane resins; and the like. Solvents used for dissolving or dispersing the binders include alcohols such as methanol, ethanol, propanol, and butanol; cellosolves such as methyl cellosolve, and ethyl cellosolve; aromatic solvents such as benzene, toluene and xylene; esters such as ethyl acetate, and butyl acetate; ketones such as acetone, methyl ethyl ketone, and cyclohexanone; hydrocarbons such as ligroine, cyclohexanone, and kerosine; dimethyl formamide; and the like.

The aforementioned thermally meltable or thermally sublimable inks may be applied by a hot-melting or solvent coating method using any one of coaters equipped with a rod, gravure screen, reversible roller, or direct roller.

The stretched cross-linked polyethylene films to be used as the thin film support in the heat transfer recording materials of the present invention are excellent in antisticking property and suitability for film. This may be presumably caused by the less adhesive, rather releasing property of the polyethylene material which exhibits a sort of lubricant effect when heated with the thermal head. This leads to prevention of the films from sticking to the thermal head. Moreover, it is considered that the suitability for film relating to the wrinkling upon winding up has been enhanced by irradiating the polyethylene films with an electron beam after extruded, but before stretched, to increase the film strength to such an extent as causing no wrinkling due to the cross-linking of the polyethylene in the process for producing the stretched cross-linked polyethylene films. Moreover, the heat transfer recording materials comprising the aforementioned stretched cross-linked polyethylene film having an ink layer containing 2 to 15% by weight oily antistatic agent applied on one side thereof allow the oily antistatic agent to migrate to the surface of the ink layer which with time, and to deposit on the side bearing no ink layer of an adjacent portion of the support, resulting in the same situation as the side bearing no ink layer which has been precoated with the oily antistatic agent. This is considered leading to the heat transfer recording materials which have an enhanced running property and hence an extraordinary high antisticking property owing to the lubricant effect exhibited by the oily antistatic agent when an energy is supplied by contacting with the thermal head.

For the above reasons, the heat transfer recording materials of the present invention have such effects as not achieved by the prior art.

The present invention will be in detail illustrated with reference to Examples hereafter.

EXAMPLES 1 TO 7 AND COMPARATIVE EXAMPLE 2

High density polyethylene (density, 0.956 g/cm$^3$; MI, 0.5 g/10 minutes) was used and formed by the T-die method into sheet. Thereafter, the sheet was treated by irradiating both sides thereof with an electron beam in a dosage of 20 Mrad, and stretched biaxially to produce a stretched cross-linked polyethylene film having a thickness of 15 μm which was employed as a support. This film had a high transparency and a breaking strength in tension (MD 80%; TD 60%), and was good in that it did not wrinkle during winding up. The thus obtained film was coated with a coating composition containing a thermally meltable ink consisting of the following components and an oily antistatic agent in amounts as shown in Table to form an ink layer in a proportion of 3 g/m$^2$ in terms of solid content.

| A. Solid formulation for the thermally meltable ink | |
|---|---|
| carbon black | 15% by weight |
| black dye | 5% by weight |
| paraffin wax | 40% by weight |
| carnauba wax | 30% by weight |
| ethylene-vinyl acetate resin | 10% by weight |
| B. Oily antistatic agent | |
| dimethyl lauryl betaine | |

The heat transfer recording material as produced above and a receiving sheet (TTR-T, a heat transfer receiving sheet, manufactured by Mitsubishi Paper Mills Ltd.) were placed in an overlapping relationship in the thermal printing device (manufactured by Matsushita Electronic Parts), and subjected to printing. The running property was evaluated by observing whether the heat transfer recording material could correctly run without causing any sticking while the printing was conducted. Moreover, the antifouling property was evaluated by observing whether any fouling was caused by rubbing the printed images with hands.

COMPARATIVE EXAMPLE 1

The procedure of Example 5 was repeated, except that the stretched cross-linked polyethylene film was replaced by a polyester film having a thickness of 16 μm. The results are shown in Table.

TABLE

| | Composition of ink layer | | Evaluation | |
|---|---|---|---|---|
| | Ink, parts (wt.) | Oily antistatic agent, parts (wt.) | Running property | Antifouling property |
| Example 1 | 100 | 0 | Δ | ○ |
| Example 2 | 99 | 1 | Δ | ○ |
| Example 3 | 98 | 2 | ○ | ○ |
| Example 4 | 95 | 5 | ○ | ○ |
| Example 5 | 90 | 10 | ○ | ○ |
| Example 6 | 88 | 12 | ○ | ○ |
| Example 7 | 85 | 15 | ○ | ○ |
| Comparative Example 1 | 90 | 10 X | — | |
| Comparative Example 2 | 80 | 20 | ○ | X |

Evaluation of the running property and the antifouling property:

○ . . . Excellent

Δ . . . Good

X . . . Bad

In Examples 3 to 7, an excellent running property and antifouling property were obtained. On the other hand, in Examples 1 and 2, the running property was somewhat inferior to that in Examples 3 to 7 because of the content of the oily antistatic agent less than 2%, though an excellent antifouling property was achieved. In Comparative Example 2, the thermally meltable ink layer was so soft that when rubbing the layer with hands, significant fouling was caused indicating a poor antifouling property, though an excellent running property was achieved.

In Comparative Example 1, the heat transfer recording material could not run at all because of the polyester film sticking to the thermal head when printing. This indicates that the inclusion of an oily antistatic agent alone can scarcely improve the running property. This would be presumably brought about because the polyester film having a higher softening point melts with the heat of the thermal head to stick thereto due to the adhesiveness of the polester film. Incidentally, antifouling property could not be evaluated because the heat transfer recording material could not run as mentioned above and hence no printed image could be obtained.

The heat transfer recording materials comprising a thin film support having an ink layer containing preferably an oily antistatic agent in accordance with the present invention does not require any heat resistant layer on the side to be in contact with the thermal head as do the conventional ones using polyester films so that simply by applying the ink layer to the stretched cross-linked polyethylene films, the heat transfer recording materials can be produced. Therefore, the present invention achieves a great practical effect in that the production of the heat transfer recording materials can be accomplished in less cost and investment.

What is claimed is:

1. A heat transfer recording material comprising a thin film support having a thermally meltable or thermally sublimable ink layer applied on one side thereof, said thin film support being made of a stretched cross-linked polyethylene film.

2. The heat transfer recording material according to claim 1, wherein said stretched cross-linked polyethylene film is produced by melt extruding a polyethylene resin by a T-die method into a film, irradiating the film with an electron beam, and then stretching the film under heat.

3. The heat transfer recording material according to claim 1, wherein said stretched cross-linked polyethylene film is made of a polyethylene resin having a density of 0.935 or more.

4. The heat transfer recording material according to claim 1, wherein said stretched cross-linked polyethylene film is made of a polyethylene resin having a density of 0.950 or more.

5. The heat transfer recording material according to claim 1, wherein said ink layer contains an oily antistatic agent in an amount of 2 to 15% by weight based on the weight of the ink layer.

6. The heat transfer recording material according to claim 5, wherein said oily antistatic agent is selected from the group consisting of nonionic surfactants, anionic surfactants, cationic surfactants, and ampholytic surfactants.

7. The heat transfer recording material according to claim 5, wherein said oily antistatic agent is selected from the group consisting of polyoxyethylene oleyl ether, sorbitan palmitate ester, sorbitan fatty acid esters, glycerin fatty acid esters, polyoxy fatty acid amides, sorbitan laurate, alkyl phosphates, aromatic phosphate esters, alkyltrimethylammonium chlorides, oxyethylene dodecyl amines, lauryl betaines, stearyl betaines, and dimethylalkyl betaines.

8. The heat transfer recording material according to claim 5, wherein said oily antistatic agent is a dimethylalkyl betaine.

9. The heat transfer recording material according to claim 5, wherein said stretched cross-linked polyethylene film is produced by melt-extruding a polyethylene resin by a T-die method into a film, irradiating the film with an electron beam, and then stretching the film under heat.

10. The heat transfer recording material according to claim 5, wherein said stretched cross-linked polyethylene film is made of a polyethylene resin having a density of 0.935 or more.

11. The heat transfer recording material according to claim 5, wherein said stretched cross-linked polyethylene film is made of a polyethylene resin having a density of 0.950 or more.

* * * * *